US005415405A

United States Patent [19]

Vincent

[11] Patent Number: 5,415,405

[45] Date of Patent: May 16, 1995

[54] HITTING SURFACE OF A GOLF CLUB HEAD

[75] Inventor: Benoit Vincent, Annecy le Vieux, France

[73] Assignee: Taylor Made Golf Company, Inc., Carlsbad, Calif.

[21] Appl. No.: 153,161

[22] Filed: Nov. 17, 1993

[30] Foreign Application Priority Data

Nov. 17, 1992 [FR] France ..... 92 14010

[51] Int. Cl.[6] ..... A63B 53/04

[52] U.S. Cl. ..... 273/175; 273/168; 273/167 J

[58] Field of Search ..... 273/167–175, 273/77 R, 77 A

[56] References Cited

U.S. PATENT DOCUMENTS

| | | | |
|---|---|---|---|
| 1,524,731 | 2/1925 | Davis | 273/175 |
| 1,536,616 | 5/1925 | Manning | 273/175 |
| 1,615,038 | 1/1927 | Reuter, Jr. | 273/175 |
| 2,023,885 | 12/1935 | Hinckley | 273/175 |
| 2,395,837 | 3/1946 | Baymiller et al. | 273/175 |
| 4,413,825 | 11/1983 | Sasse | 273/175 |
| 4,521,022 | 6/1985 | Schmidt | 273/175 |

FOREIGN PATENT DOCUMENTS 3425046 6/1986 Germany .

OTHER PUBLICATIONS

Search Report FR 9214010.

*Primary Examiner*—Vincent Millin
*Assistant Examiner*—Steven Wong
*Attorney, Agent, or Firm*—Pollock, Vande Sande & Priddy

[57] ABSTRACT

Golf club head comprising an imaginary line formed by the intersection of the hitting surface (3) with a plane (P) passing through the center of the surface (O) and perpendicular, first, to the hitting plane (T) and second, to the plane (Q) tangent to the hitting surface (3) in the center of the surface (O), this imaginary line (L) being constituted by a series of portions of arcs of circles. The imaginary line is formed by two half-lines (L1, L2) adjacent to the center of the surface (O) and mutually asymmetrical, the number of portions is at least three, and the values of the radii of the arcs of circles are different from one adjacent portion to the next.

11 Claims, 8 Drawing Sheets

HITTING SURFACE OF A GOLF CLUB HEAD

FIELD OF THE INVENTION

The present invention concerns a golf club head. It concerns, more particularly, an improvement involving its hitting surface.

BACKGROUND OF THE INVENTION

During the practice of golf, the player hits the ball to move it, by propelling it with a golf club constituted by a shaft, which comprises a head at its lower end, while its upper end is equipped with a handle, commonly called a grip.

At present, the clubs used by golfers at the tee, or start of the hole, to drive the ball long distances, are called woods. In the beginning, the woods were built in their entirety from wood, such as persimmon or other similar varieties. These clubs are still prized by many players; but they are not very "forgiving," given the low density of the material used and its uniform distribution behind the hitting surface of the club head. To overcome this problem, the "wood-metal" club was produced. This club incorporates the shape of the wood, by the head is made in its entirety of steel. Given the high density of material used and the weight restrictions imposed, the wood-metal club generally comprises a hollow steel head, normally produced using the lost-waxcasting process.

One property common to all heads, whether they are made of wood, steel, or a composite material, is that they all have a hitting surface which is inclined in relation to the ground and which is both convex in horizontal sections forming what is called the "bulge," and in vertical sections forming what is called the "roll." The convex shape in horizontal cross-section of the hitting surface is designed to correct ball trajectories which, because of the rotation of the head resulting from impact, undergo lateral deviation to the right or left. However, the corrections brought about by the current shapes of the hitting surfaces are not produced under good conditions, and the trajectories are particularly inaccurate. It is observed, in particular, that the heads do not perform symmetrically when the ball is struck off-center, either toward the heel or the tip of the head. Because the shaft and the neck are positioned on the heel side, the head tends to pivot less during a stroke offset toward the heel than when the stroke is offset toward the tip (where the head pivots in the reverse direction, and from front to back). Because the rotational motions of the head, added to the meshing effect, are the source of the right and left deviations from a rectilinear path, these deviations must be rectified through the geometry of the hitting surface, whose traditionally-accepted symmetry is thus called into question.

SUMMARY OF THE INVENTION

The purpose of the present invention is to solve the problems raised by present-day golf club heads and to propose a club head whose surface geometry is new and makes it possible to achieve enhanced accuracy of ball trajectories.

Thus, the golf club head according to the invention comprising an imaginary line formed by the intersection of the hitting surface with a plane passing through the center of the surface and which is perpendicular, first, to the hitting plane and second, to the plane tangent to the hitting surface at the center of the surface, said imaginary line being formed by a succession of portions of arcs of circles, is characterized by the fact that the imaginary line is formed by two half-lines adjacent to the center of the surface, and which are mutually asymmetrical, and by the fact that the number of portions is at least three and the values of the radii of the arcs of circles are different from one adjacent portion to another.

According to an additional feature, the center of the surface is a point connecting two adjacent portions.

According to another feature, the center of the surface is a point falling within one of these portions and which extends on either side of this point.

In a special arrangement, each half-line is formed from two adjacent portions, a first central portion attaching to the center of the surface, and a second end portion connecting with the first, and, according to a first variant, the radius of the arc of circle of the first central portion is greater than the radius of the arc of circle of the second end portion, while, in a second variant, the radius of the arc of circle of the first central portion is smaller than the radius of the arc of circle of the second end portion.

According to another additional feature, with respect to one of the half-lines, the radius of the arc of circle of the first central portion is greater than the radius of the arc of circle of the second end portion; while, with respect to the other half-line, the radius of the arc of circle of the first central portion is smaller than the radius of the arc of circle of the second end portion.

In another variant provided as an example, the imaginary line comprises a central portion connected on either side to two lateral portions, and, in one of the embodiments, the radius of the arc of circle of the central portion is smaller than the radii of the arcs of circle of the two lateral portions; while, in another embodiment, the radius of the arc of circle of the central portion is greater than the radii of the arcs of circle of the two lateral portions.

It should be further noted that the different radii of the arcs of circle of the various portions advantageously range between 117.8 and 508 millimeters (i.e., between 7 and 20 inches).

BRIEF DESCRIPTION OF THE DRAWING

Other features and advantages of the invention will emerge from the following description provided with reference to the attached drawings, which are given only by virtue of example:

FIG. 1 is an exterior front view.

FIG. 2 is an exterior side view, with partial pull-away.

FIG. 3 is a top view.

FIGS. 4 and 5 are perspective views, FIG. 4 being a rear perspective, and FIG. 5, a front perspective view.

DESCRIPTION OF THE PREFERRED EMBODIMENT

Figure 1:
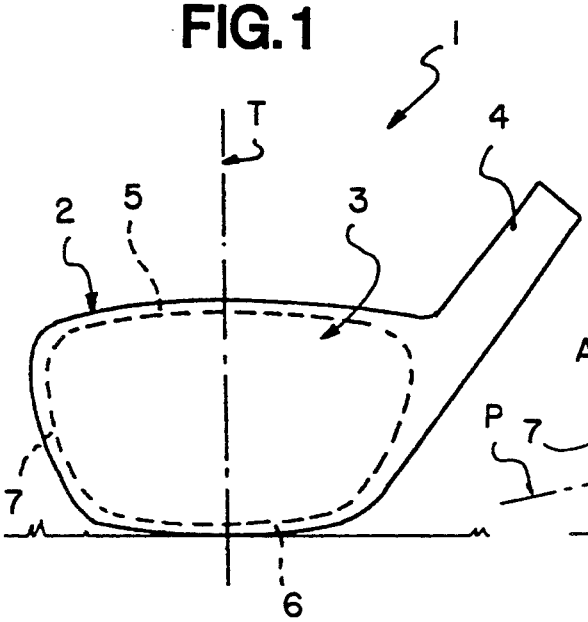
FIGS. 1 to 5 illustrate a head according to the invention.
Figure 2:
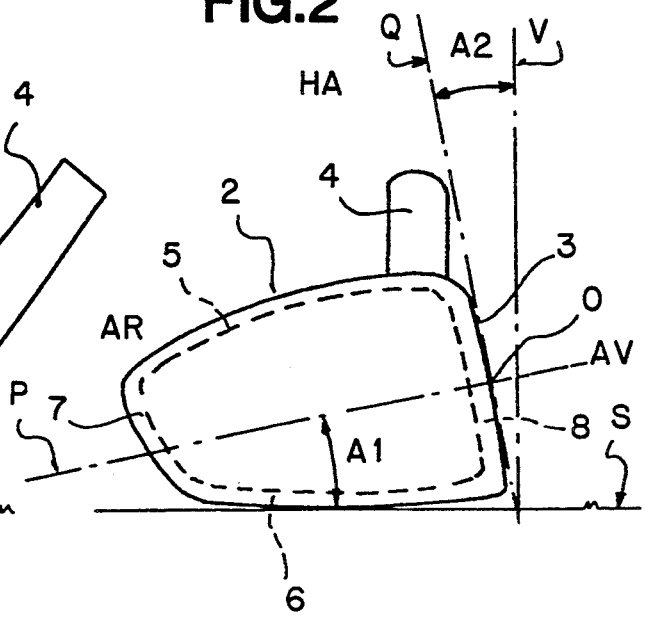
Figure 3:
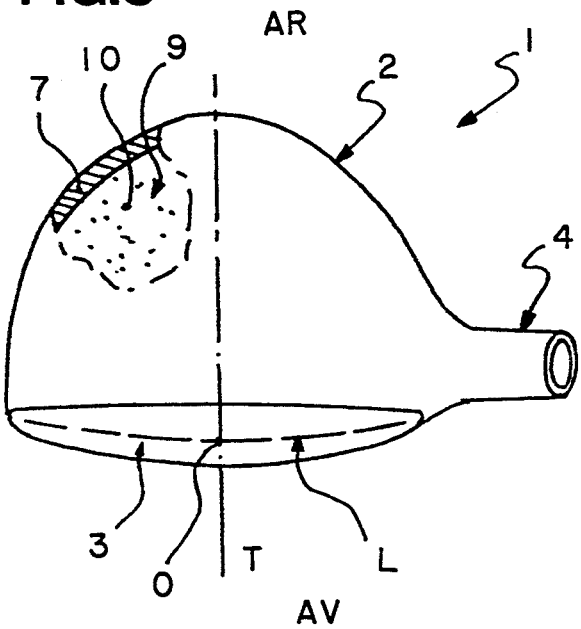
Figure 4:
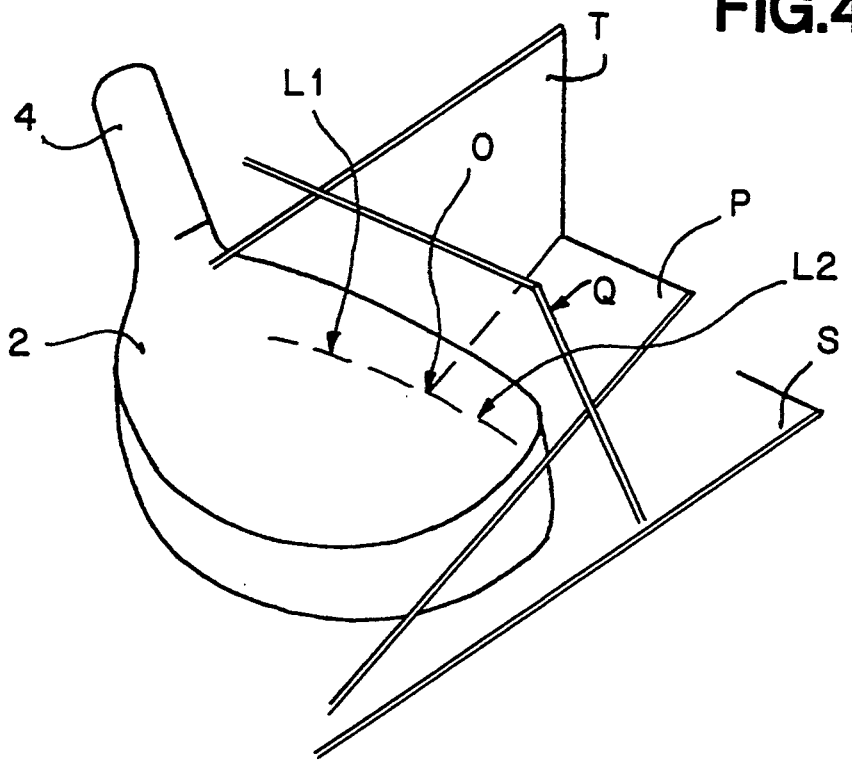
Figure 5:
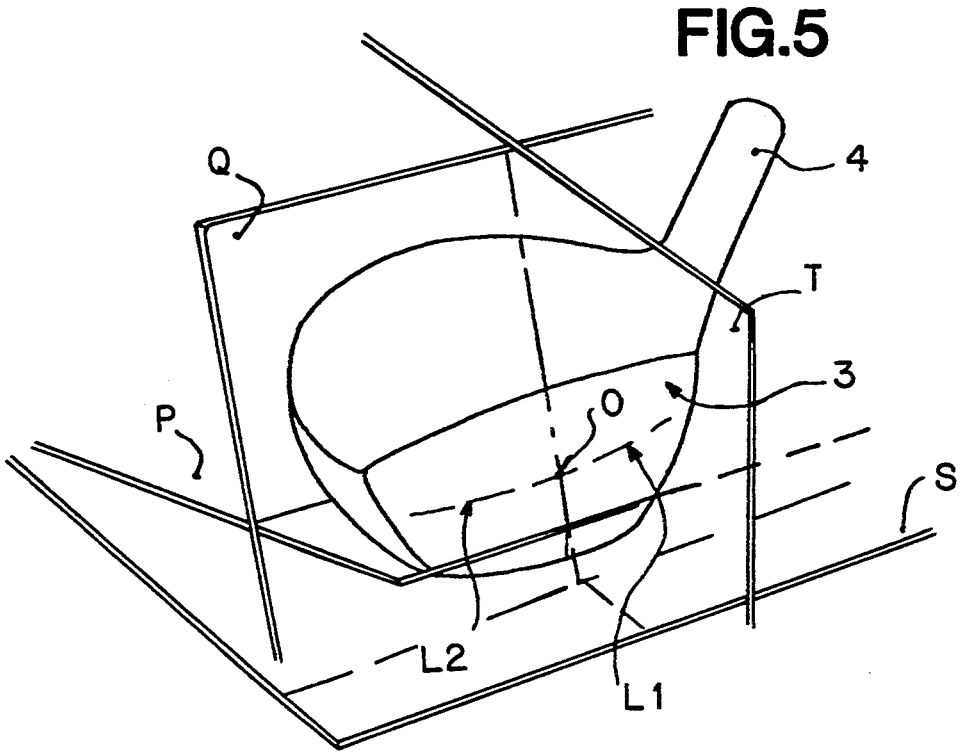

The golf club head bearing the reference 1 and illustrated as an example, is a head of the type formed by a shell 2 comprising a hitting surface 3, said head being extended laterally and upward by a neck 4 designed to receive the club shaft (not shown). The shell itself is formed by a metal, plastic or composite material jacket, and comprises a series of walls, i.e, an upper wall 5, a lower wall 6, a peripheral wall 7, and a front wall 8. These different walls form, moreover, a sealed hollow body incorporating an inner cavity advantageously filled with a foam 10, such as a polyurethane foam. The head comprises a hitting line T which, at the time of impact, is perpendicular to the plane S of the ground s, which defines substantially its general plane of symmetry and passes through the center of the surface (O). Of course, the shell may also be formed by a jacket other than a metal one, e.g.,a jacket made of plastic or a composite material. Similarly, the golf club head can be of any other type, since the invention concerns the shape of its hitting surface.

The front wall 8 forms the hitting wall, and its front face 3, the ball hitting surface. The ideal point of impact of the hitting surface on the ball is the center O. The hitting surface 3 is a curved surface bulging forward AV, so as to be convex in all directions. Thus, the various intersections of this hitting surface 3 with the longitudinal vertical planes parallel to the hitting plane are curves. Similarly, the different intersections of the surface with horizontal planes are also curves.

Let us note, moreover, that the overall shape of the hitting surface 3 extends upward HA and to the rear, so as to be inclined toward the rear. It comprises an imaginary line L formed by the intersection of the hitting surface with an inclined plane P passing through the center of the surface O, this plane being perpendicular, first, to the hitting plane T, and second, to the plane Q tangent to the hitting surface in the center of the surface O. Accordingly, the plane P forms, with the plane of the ground, a dihedron open toward the front AV and whose interior angle A1 is equal to the angle of opening A2 of the surface, this surface being such that the imaginary line L defines two half lines L1, L2 adjacent to the center of the surface O and asymmetrical in relation to the hitting plane T: a first, internal half-line L1 and a second, external half-line L2. Moreover, the imaginary line L is delineated by a succession of portions of arcs of circles, and, according to one invention feature, the imaginary line L is formed by at least three portions of arcs of circles, whose respective radii are such that they differ from one adjacent portion to another.

Figure 6:
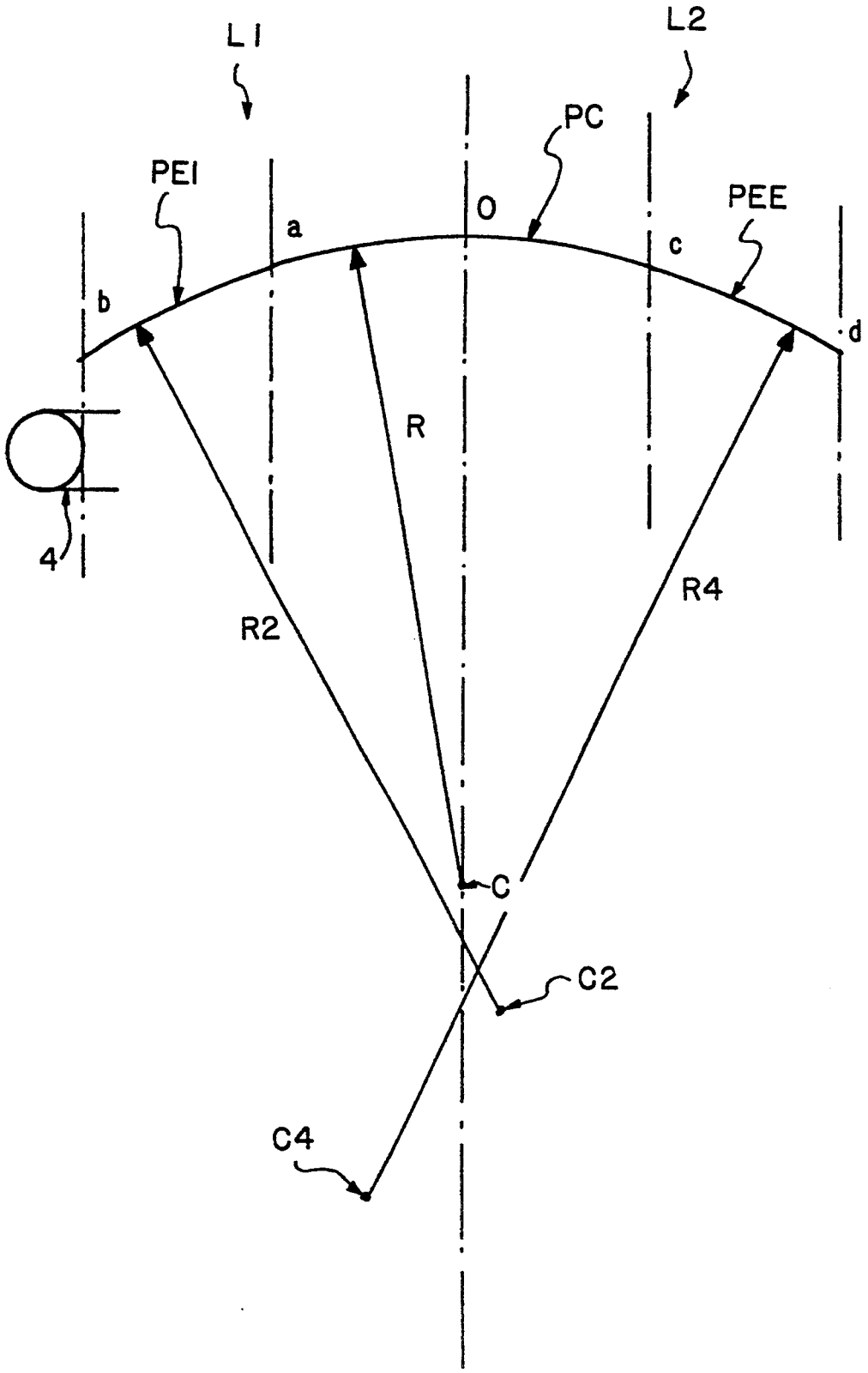
FIGS. 6 to 11 represent six embodiments of the imaginary line formed by the intersection of the hitting surface with an inclined plane passing through the center of the surface and being perpendicular, first, to the hitting plane and second, to the plane tangent to the hitting surface at the center of the surface.
Figure 7:
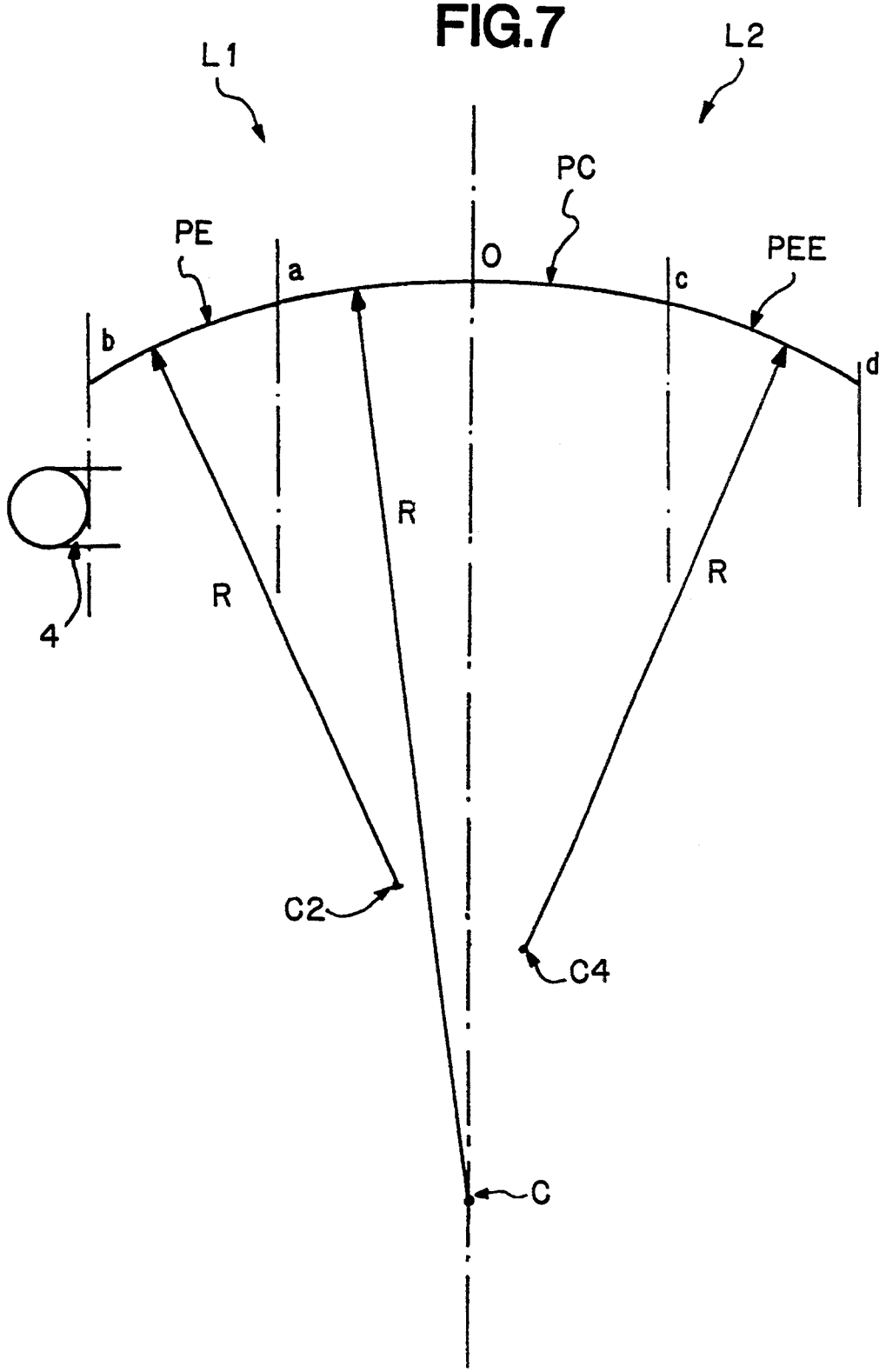

In the first two embodiments illustrated in FIGS. 6 and 7, the imaginary line L is formed by the central portion (PC, segment ac), extended on either side by two lateral end portions, an internal end portion (PEI, segment ab) and an external end portion (PEE, segment cd), respectively. Thus, the central portion is an arc of a circle having radius R, while the internal end portion PEI is an arc of a circle having radius R2, the external end portion PEE being an arc of a circle having radius R4.

In the first embodiment illustrated in FIG. 6, the internal and external end portions PEI and PEE are such that the radius R2, R4 of their arcs has a value greater than that of the radius R of the central portion PC. It should also be noted that the radius R4 of the external end portion PEE has a value greater than the radius R2 of the internal end portion PEI.

In the second embodiment illustrated in FIG. 7, the internal and external end portions are such that the radii R2, R4 of their arcs have a value smaller than the radius R of the central portion. It should also be noted that the radius R4 of the external end portion PEE has a value greater than that of the radius R2 of the internal end portion PEI.

As an example, the different successive portions of the first embodiment may be such that R has a value of 254 millimeters (10 inches), while the radius R2 is equal to 304.80 millimeters (12 inches), and the radius R4, a value of 381 millimeters (15 inches). Moreover, the second embodiment may be such that the radius R1 is 355.60 millimeters (14 inches), the radius R2 having a value of 228.6 millimeters (9 inches) and the radius R4, a value of 254 millimeters (10 inches).

Figure 8:
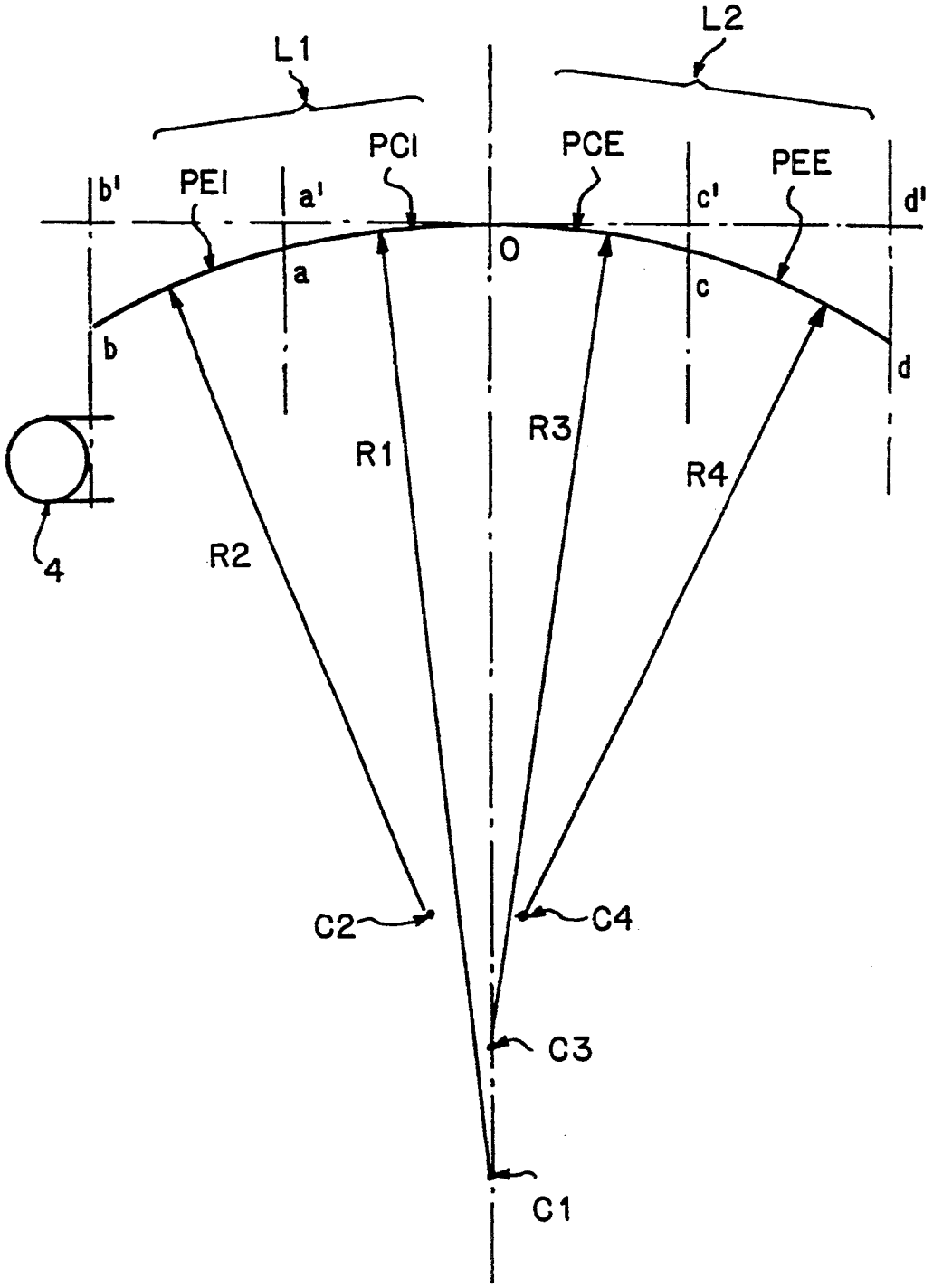
Figure 9:
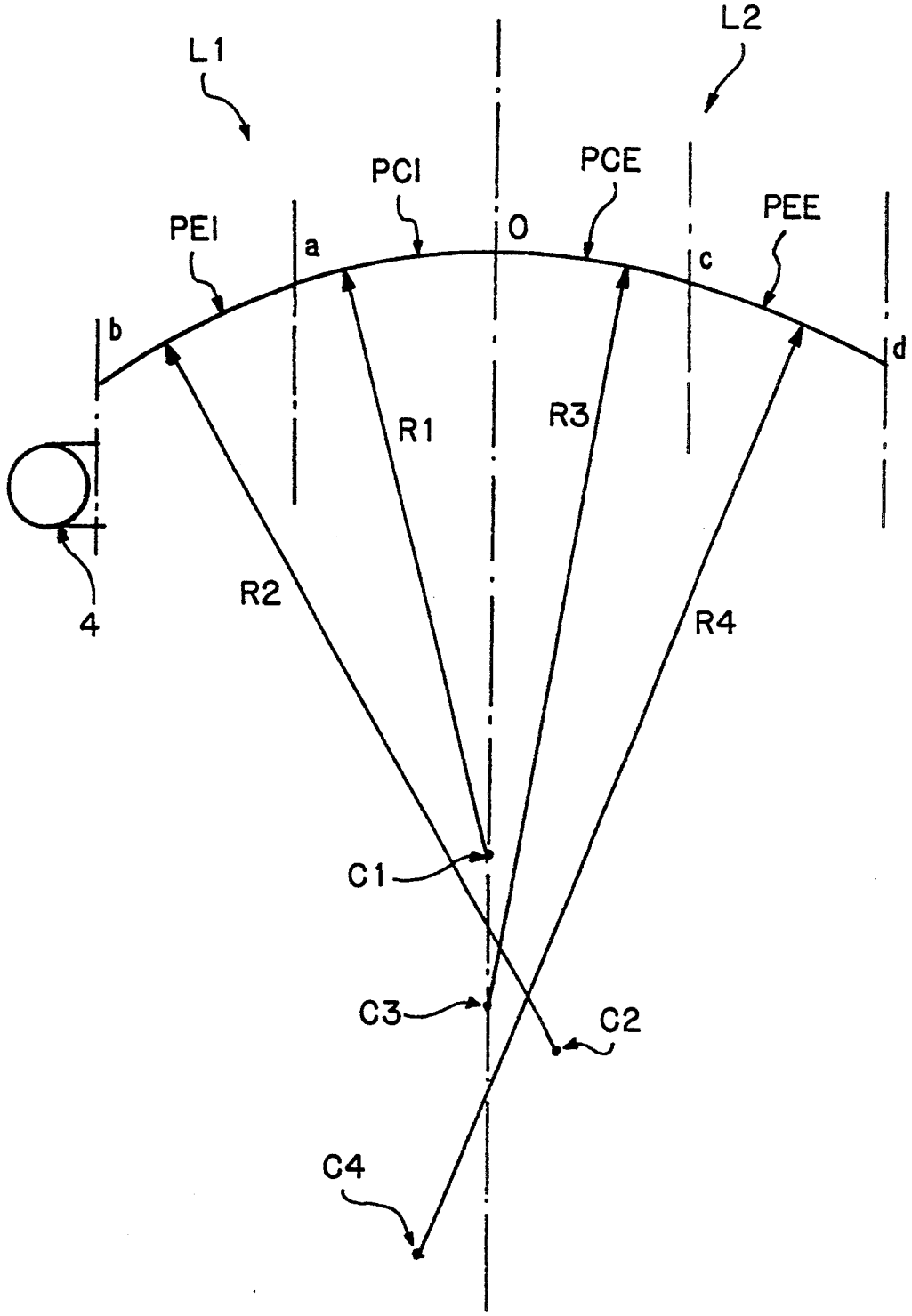
Figure 10:
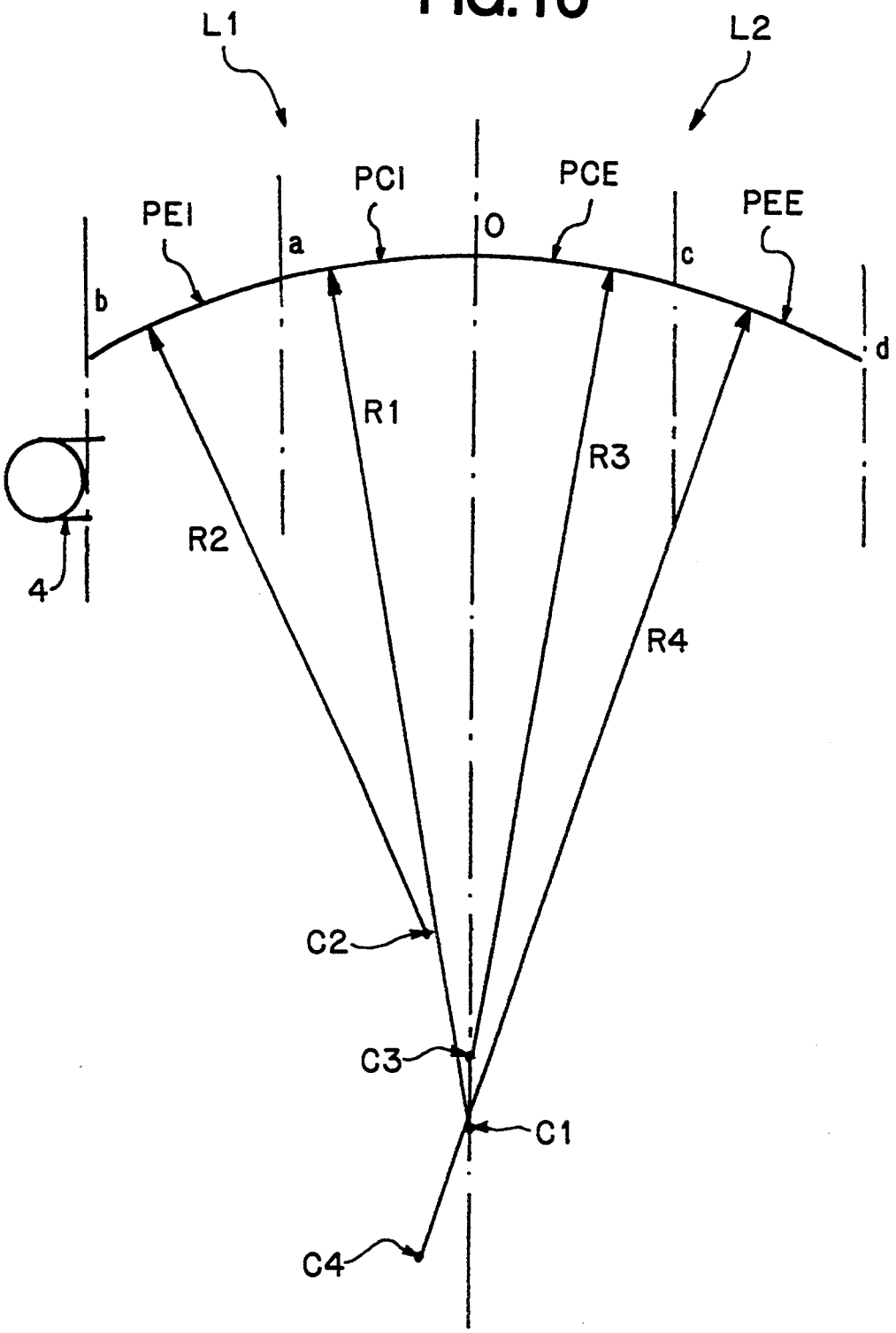

In the other embodiments illustrated in FIGS. 8 to 10, it will be noted that the central portion is formed from two portions adjacent to the center of the surface, i.e., an internal central portion PCI, which is an arc whose radius is R1, and an external central portion PCE, whose radius is R3.

FIGS. 8 to 10 illustrate preferred embodiments of the invention, according to which the internal half-line L1 is formed by two adjacent portions, i.e., a first internal central portion PCI, segment oa, extended inward by a second internal end portion PEI, segment ab, the two portions of the junction point being adjacent to each other, while the first internal central portion PCI is a curve formed by a portion oa of a circle having radius R1, and while the second internal end portion PEI is another curve formed by a portion av of a circle having radius R2. The external half-line L2 is formed by two adjacent portions, i.e., a first external central portion PCE, segment oc, extended outward EX by a second external end portion PEE, segment cd. The two portions of the junction point c are adjacent to each other, while the first external central portion PCE is a curve formed by a portion oc of a circle having radius RE, and while the second external end portion PEE is another curve formed by a portion cd of a circle having radius R4.

In the third embodiment, illustrated in FIG. 8, the two end portions are portions of arcs of circles whose radii are equal. Accordingly, the radius R2 of the internal end portion PEI is equal to the radius R4 of the external end portion PEE, the two central portions being portions of arcs of circles whose radii have different values, R1 then being different from R3. Thus, in this third embodiment, the different radii of the portions of arcs of circles may have the following values: R1 is 355.60 millimeters (14 inches), R3 is 304.80 millimeters (12 inches), while R2 is equal to R4 and to 254 millimeters (10 inches). It will be noted that, in this embodiment, the central portions are arcs of circles whose radii are greater than the radii of the arcs of circles of the corresponding adjacent lateral portions.

In the fourth embodiment, shown in FIG. 9, it will be noted that the case is different. In fact, the radii of the arcs of circles of the central portions are smaller than the radii of the arcs of circles of the corresponding adjacent lateral portions, while the radii of the arcs of circles of the two central portions are different. Accordingly, the radius R1 may have a value of 228.6 millimeters (9 inches), while the radius R2 is 304.8 millimeters (12 inches), the radius R3 is equal to 279.4 millimeters (11 inches) and the radius R4, to 381 millimeters (15 inches).

The embodiment illustrated in FIG. 10 is a mixed one, in which, on one of the half-lines, the radius of the arc of the circle of the central portion is greater than the radius of the arc of the circle of the adjacent end portion; while, on the other half-line, the arrangement is reversed, i.e., the radius of the arc of circle of the central portion is smaller than the radius of the arc of circle of the adjacent end portion. The embodiment illustrated in FIG. 10 as an example of this mixed implementation is such that the radius R1 is 330.2 millimeters (13 inches), the radius R2, 254 millimeters (10 inches), radius R3, 304.8 millimeters (12 inches), and radius R4, 381 millimeters (15 inches).

Figure 11:
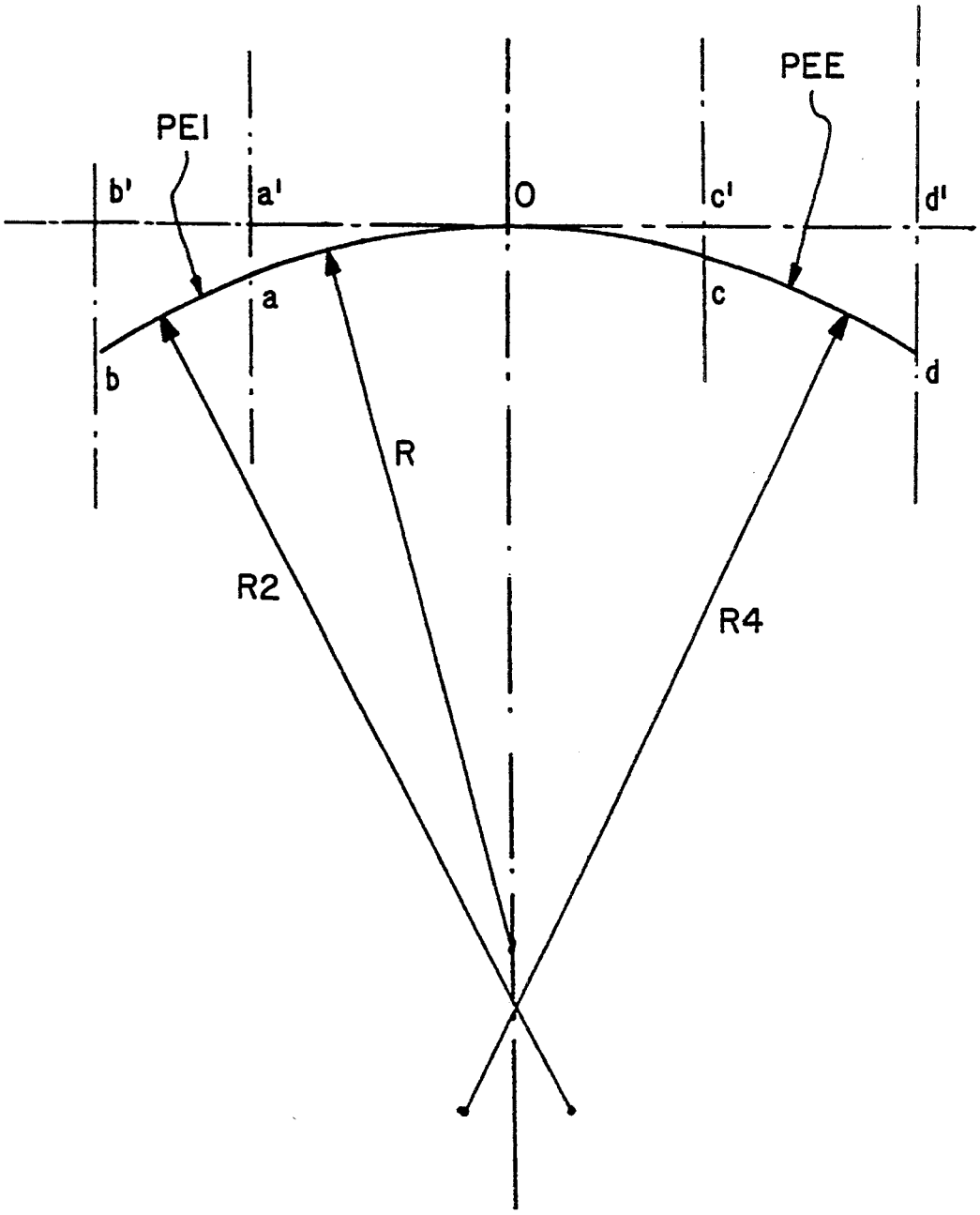

In the embodiments illustrated above, it will be noted that the length of the projection for the various successive portions on plane A is substantially equal. Accordingly, the segments oa', a'b', oc', and c'd' are equal. However, the situation could be otherwise, as in the embodiment in FIG. 11, a variant in which the imaginary line comprises three adjacent portions, i.e., a central portion PC extended laterally by two end portions PEI, PEE, and in which the length of the segment a'b' is different from that of segment c'd', while the radius R of the central portion PC is smaller than the radius R2 of the internal end portion PEI and than the radius R4 of the outer end portion PEE, said radius R4 being, moreover, equal to the radius R2.

Of course, the invention is not limited to the embodiments described and illustrated as examples, but encompasses all technical equivalents and combinations thereof.

What is claimed is:

1. Golf club head comprising an imaginary line (L) defined by the intersection of a hitting surface with a first plane passing through the center of said hitting surface and perpendicular both to a hitting plane and to a second plane tangent to said hitting surface in the center of said hitting surface, said imaginary line being formed by a succession of at least three portions of arcs of circles, wherein said imaginary line is formed by two half-lines adjacent to the center of said hitting surface and mutually asymmetrical, the radii of said arcs of circles differing from one adjacent portion to another.

2. Golf club head according to claim 1, wherein the center of said hitting surface is a point connecting two adjacent portions.

3. Golf club head according to claim 1, wherein the center of said hitting surface is a point falling within said portions and extends on either side of said point.

4. Golf club head according to claim 2, wherein each said half line is formed by two adjacent portions, namely, a first central portion connecting with the center of said hitting surface, and a second, end portion connecting with said first portion.

5. Golf club head according to claim 4, wherein the radius of the arc of circle of said first, central portion is greater than the radius of the arc of circle of said second, end portion.

6. Golf club head according to claim 4, wherein the radius of the arc of circle of said first, central portion is smaller than the radius of the arc of circle of said second, end portion.

7. Golf club head according to claim 4, wherein, with respect to one of the half lines, the radius of the arc of circle of said first, central portion is greater than the radius of the arc of circle of said second, end portion while, with respect to the other half line, the radius of the arc of circle of said first, central portion is smaller than the radius of said second, end portion.

8. Golf club head according to claim 3, wherein the line comprises a central portion connected on either side to two lateral portions.

9. Golf club head according to claim 8, wherein the radius of the arc of circle of said central portion is smaller than the radii of the arcs of circles of said two lateral portions.

10. Golf club head according to claim 8, wherein the radius of the arc of circle of said central portion is greater than the radii of the arcs of circles of said lateral portions.

11. Golf club head according to claim 1, wherein the different radii of the arcs of circles of the different portions range from 177.8 to 508 millimeters (7 to 20 inches).

* * * * *